US005240275A

United States Patent [19]

Jungkind

[11] Patent Number: 5,240,275

[45] Date of Patent: Aug. 31, 1993

[54] SAFETY SKI BINDING HAVING A PIVOTABLE SOLE PLATE

[76] Inventor: Roland Jungkind, Bärenalplstrasse 3, 8100 Garmisch-Partenkirchen, Fed. Rep. of Germany

[21] Appl. No.: 777,416

[22] PCT Filed: Mar. 12, 1991

[86] PCT No.: PCT/DE91/00217

§ 371 Date: Nov. 27, 1991

§ 102(e) Date: Nov. 27, 1991

[87] PCT Pub. No.: WO91/14484

PCT Pub. Date: Oct. 3, 1991

[30] Foreign Application Priority Data

Mar. 29, 1990 [DE] Fed. Rep. of Germany ..... 4010050
Jul. 19, 1990 [DE] Fed. Rep. of Germany ..... 4022945

[51] Int. Cl.[5] ..... A63C 9/081

[52] U.S. Cl. ..... 280/618; 280/626; 280/629

[58] Field of Search ..... 280/618, 617, 607, 626, 280/625, 629, 634

[56] References Cited

U.S. PATENT DOCUMENTS 3,907,318 9/1975 Salomon ..... 280/618
4,479,664 10/1984 Gertsch ..... 280/618
4,779,891 10/1988 Freisinger et al. ..... 280/629

FOREIGN PATENT DOCUMENTS 385423 9/1987 Austria .
390380 10/1989 Austria .
0069753 8/1982 European Pat. Off. .
3343943 6/1985 Fed. Rep. of Germany .
3515847 11/1986 Fed. Rep. of Germany .

*Primary Examiner*—Eric D. Culbreth
*Attorney, Agent, or Firm*—Hoffmann & Baron

[57] ABSTRACT

A safety ski binding having a sole plate which is pivotable parallel to the surface of the ski, a pair of sole holders (30) which are each pivotable about a respective axis which is perpendicular to the sole plate between a holding position and a release position for a ski boot, and a release assembly for the sole holders, which has a respective guide link (32) pivotally mounted to the sole holders, and a release member (37) which is mounted movably on the sole plate. In the holding position of the sole holders the guide links bear against a support element (35) which is fixed with respect to the plate, at an angle such that they are urged in a direction towards the release member (37), on the basis of the principle of the inclined plane. In that arrangement the portion of the support force which is carried by the support element (35) is considerably greater than the portion which is to be carried by the release member (37) so that upon a lateral pivotal movement of the sole plate and when the release member (37) comes to bear against an abutment wall (28') which is fixed with respect to the ski, only the low friction force between the release member and the guide links has to be overcome. That avoids the occurrance of a torque peak in the force/torque characteristic of the ski binding during the release procedure.

27 Claims, 10 Drawing Sheets

SAFETY SKI BINDING HAVING A PIVOTABLE SOLE PLATE

The invention relates to a safety ski binding.

A safety ski binding of that kind is known and is illustrated in attached FIGS. 1 and 2. It has a sole plate 1, on the front end of which is arranged a holder, as generally indicated by reference numeral 2, for the front edge of the sole of a ski boot 3, while arranged on the sole plate 1 at the rear end thereof is a heel holder 4. The invention is concerned solely with the front holder so that the nature and configuration of the heel holder 4 will not be discussed in detail here and hereinafter in the description of the embodiments by way of example of the invention.

Two sole holders 6 are mounted pivotably by means of pins 7 at the front end of the sole plate 1 which is pivotable about a pin 5, parallel to the surface of the ski. Pivotally connected to the front end of each sole holder 6 is a guide link 8 which in the illustrated holding position of the sole holders 6 bears against the periphery of a release member 9. The release member 9 is pivotably mounted on a pivot axis member 10 and has an abutment finger 11. The two guide links 8 are so oriented relative to the pivot axis member 10 of the release member 9 that the line of their bearing support force intersects that axis member or extends slightly behind same. In addition the two guide links 8 are drawn into a position of bearing against a shoulder on the release member 8, which can be seen in FIG. 2, by a leg spring 12.

In the illustrated holding position of the sole holders 6 they embrace the front edge of the sole of the ski boot 3 and hold it firmly on the sole plate 1, in relation to lateral movements. In addition, the sole plate 1 is resiliently fixed in relation to lateral pivotal movements about the pin 5 by holding means of the heel holder which are known and are therefore not to be described in greater detail herein (see for example EP-A-69 753). If now the foot of the skier is subjected to a lateral torque loading which overcomes the resilient holding means, the holding means permit a lateral pivotal movement of the sole plate 1 about the pin 5, with the entire sole holder 2 also moving with the sole holders 1 in an unchanged holding position. If that lateral torque loading is of only short distance, for example in the situation involving a lateral blow against the ski, the sole plate 1 is returned to its initial position under the effect of the resilient holding means. In that situation there is no safety release action. If however the torque loading is of longer duration, which involves the risk of injury to the leg of the skier, then the sole plate 1 is pivoted further until a pivot angle which is predetermined by virtue of the abutment finger 11 bearing against a wall 13 which is fixed with respect to the ski (see FIG. 1) is exceeded. That causes the abutment finger 11 and therewith the release member 9 to be pivoted so that, depending on the respective direction of pivotal movement, one of the two guide links 8 is moved out of its support position by the shoulder disposed on the release member 9. As soon as the line of the bearing force of that guide link 8 passes in front of the pivot axis member 10, it is no longer possible for the guide link 8 to be supported against the release member 9; the associated sole holder 6 is pivotally deflected and releases the ski boot 3.

That safety ski binding is not without its disadvantages which will now be discussed with reference to FIG. 9: FIG. 9 shows in purely qualitative terms in solid line the desired force/travel configuration of the release force acting on the sole plate 1, during a safety release operation. Accordingly, at the beginning of the pivotal travel of the sole plate 1, the force applied by the holding means of the heel holder 4 is supposed quickly to attain its full value and then remain substantially constant over the entire release travel until safety release occurs, that is to say, until there is a lateral pivotal movement of one of the sole holders 6. When the sole holder 6 is released the spring force of the holding means deceases again, it is not possible to achieve an ideal characteristic of that kind with the front holding arrangement 2 of the known safety ski binding. For, having regard to the tolerances involved due to manufacture, and the fact that due to vibration or impacts during use the guide links may not be moved out of their support position and thus permit unintentional release of the sole holders 6, the support position is so defined in structural terms that in any case the line of the support force extends behind the axis member 10 of the release member 9, that is to say the guide links 8 are held in an over-dead-center position. The result of that is that, when the abutment finger 11 bears against the well 13 which is fixed with respect to the ski, a predistransitial force must be applied to eject the corresponding guide link 8 because the over-dead-center position, the friction between the bearing end of the guide link and the release member, and the force of the spring 12, have to be overcome. That additional force generates the torque peak S shown in dotted line in FIG. 9, which loads the foot and the leg of the skier at a critical moment, namely when the musculature is in any case already under stress and ligaments are substantially stretched.

Injuries resulting from that can only be avoided if the release characteristic of the safety ski binding is made so low, even for the weakest setting, for example for children, that there is no risk of injury, even in consideration of the torque peak S. That however involves the significant disadvantage that, when the safety ski binding is set at a stronger setting, for example for adults or for advanced skiers, the force/travel configuration in terms of release no longer corresponds to the desired ideal configuration, but assumes the unfavourable configuration shown in dash-dotted lines in FIG. 9.

Therefore the object of the invention is so to improve a safety ski binding of the kind indicated that a significant torque peak in the force/travel characteristic in the release operation does not occur and therefore even at high setting values for the safety ski binding it is possible to embody a characteristic which comes close to the ideal configuration. In that respect the invention seeks to provide that the structural configuration of the ski binding is not made more complicated.

The invention is based on the consideration that any additional force which is required for moving the guide links out of their support position must be avoided and therefore the support or bearing force which is transmitted from the ski boot to the sole holder and from there in turn to the guide link should itself be used for producing that movement of the guide links out of their support position. For that purpose, in accordance with the invention, an additional support element is used for supporting the guide links, besides the release member, and the support force is so distributed to those two that the support force portion which is carried by the support element is considerably greater than the support force portion which is carried by the release member.

That can be arranged as desired in structural terms by virtue of the arrangement of the line of force of the respective support force portion at the guide link. In addition, the invention further provides that the support force which obtains between the support end of the respective guide link and the support element urges the support end towards the release member and therefore produces the support force portion which is to be carried thereby. Upon safety release of the ski binding therefore all that is required is for the release member to be moved out of the locking position thereof, without same requiring the effect of a force which goes beyond practically negligible frictional influences, for moving the guide links out of their support position. The frictional influences involved are negligibly slight for the reason that the support force which occurs between the release member and the support end of the guide links intentionally constitutes only a small part of the overall support force, for example only 5 or 10% thereof. As soon as the release member has moved out of its locking position, the force equilibrium which fixes the guide links is disturbed and the support force portion which hitherto was carried by the release member is free and causes movement of the guide link out of its support position. That means however that a force or torque peak does not occur in the force/travel configuration, or occurs only to an imperceptible degree, so that such a peak no longer has to be incorporated into the calculations when establishing the release characteristic.

The release arrangement according to the invention may be embodied in many different ways from the structural point of view. At any event, the principle of the inclined plane is utilized for the purposes of support of the support ends of the guide links against the support element so that the support force is divided into a component which loads the support element and a component which acts perpendicularly thereto and which urges the support end in a direction towards the release member. In that respect the contact surface which forms the inclined plane may be associated either with the support element or the support end of the guide link or both. The configuration of that contact surface respectively depends on the location on the sole holders at which the guide links are pivotally mounted. Embodiments of structurally simple configurations of the concept of the invention are described hereinafter with reference to the accompanying drawings. Some of the illustrated embodiments of the safety ski binding provide that the guide links are pivotally mounted to the sole holders and bear against a release member and also against a support element which is fixedly connected to the sole plate. In others, it is provided that the guide links are each pivotally mounted to a mounting portion which is fixedly connected to the sole plate and that each sole holder carries a support element. By virtue of that configuration it is possible to solve the underlying problem of the invention in the same manner but with fewer components, In the drawings:

Figure 1:
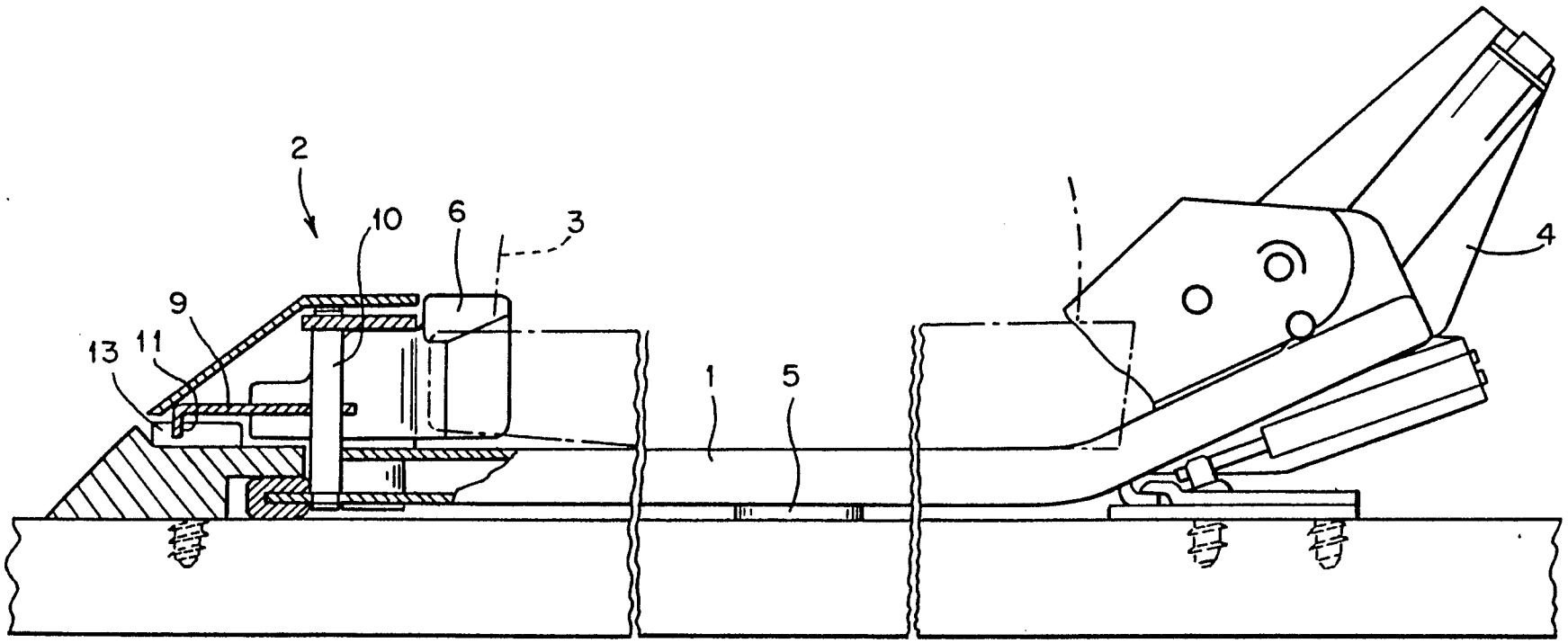
FIG. 1 (Prior Art)
FIGS. 1 and 2 are a partly sectional, broken-away side view of a safety ski binding in accordance with the state of the art, and a horizontal section through the front sole holding arrangement thereof.
Figure 2:
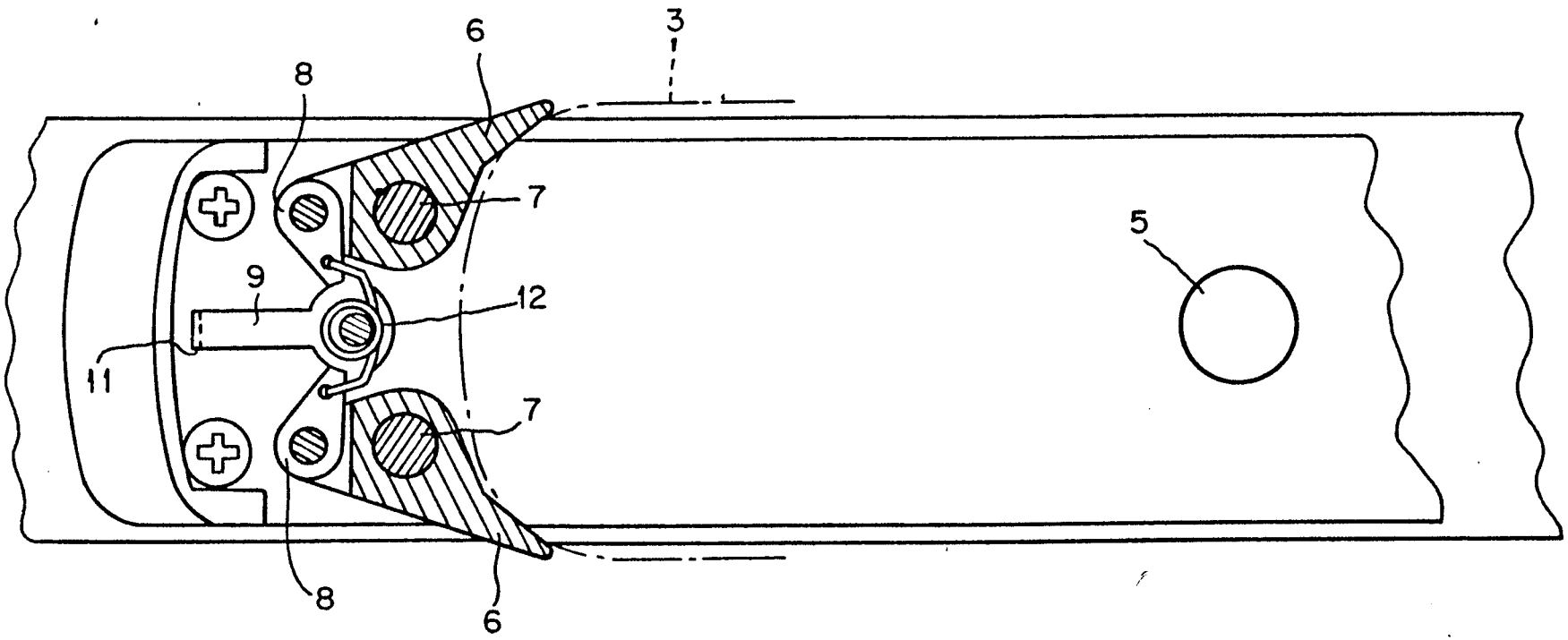
FIG. 2 (Prior Art)
Figure 3:
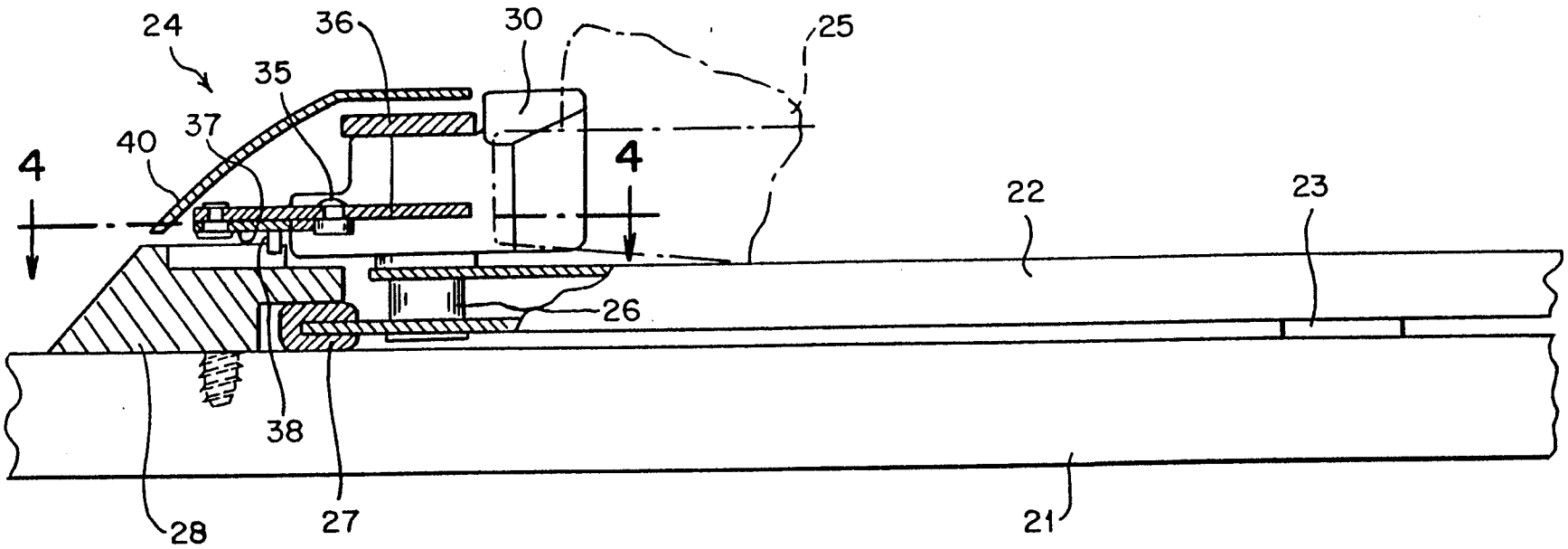
FIG. 3 is a view in section through the front sole holding arrangement taken along line III—III in FIG. 4 in a safety ski binding according to the invention.
Figure 4:
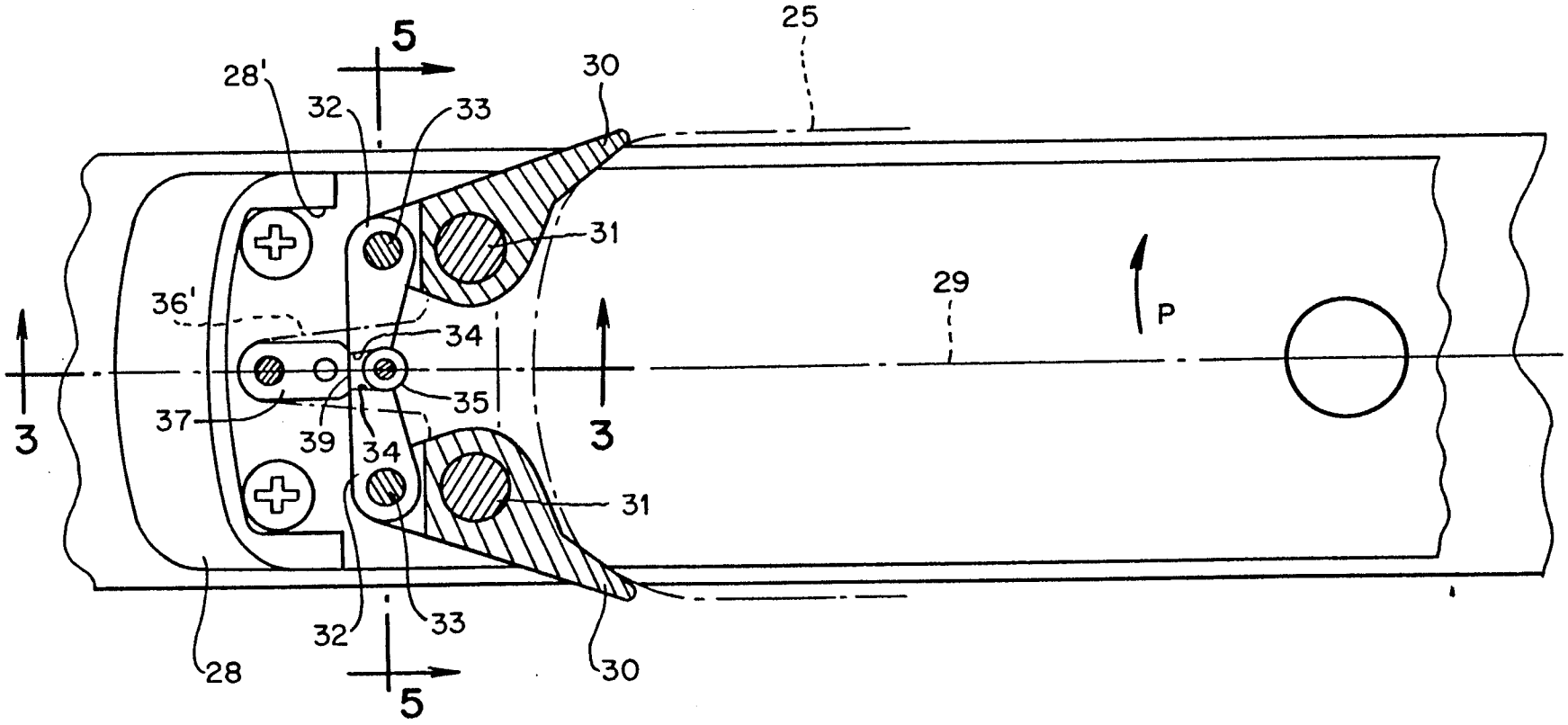
FIG. 4 is a view in section parallel to the surface of the ski, taken along line IV—IV in FIG. 3.
Figure 5:
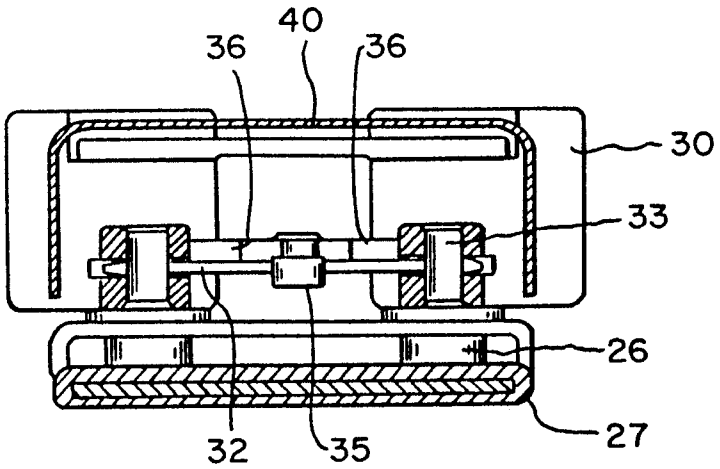
FIG. 5 is a view in section taken along line V—V in FIG. 4.
Figure 10:
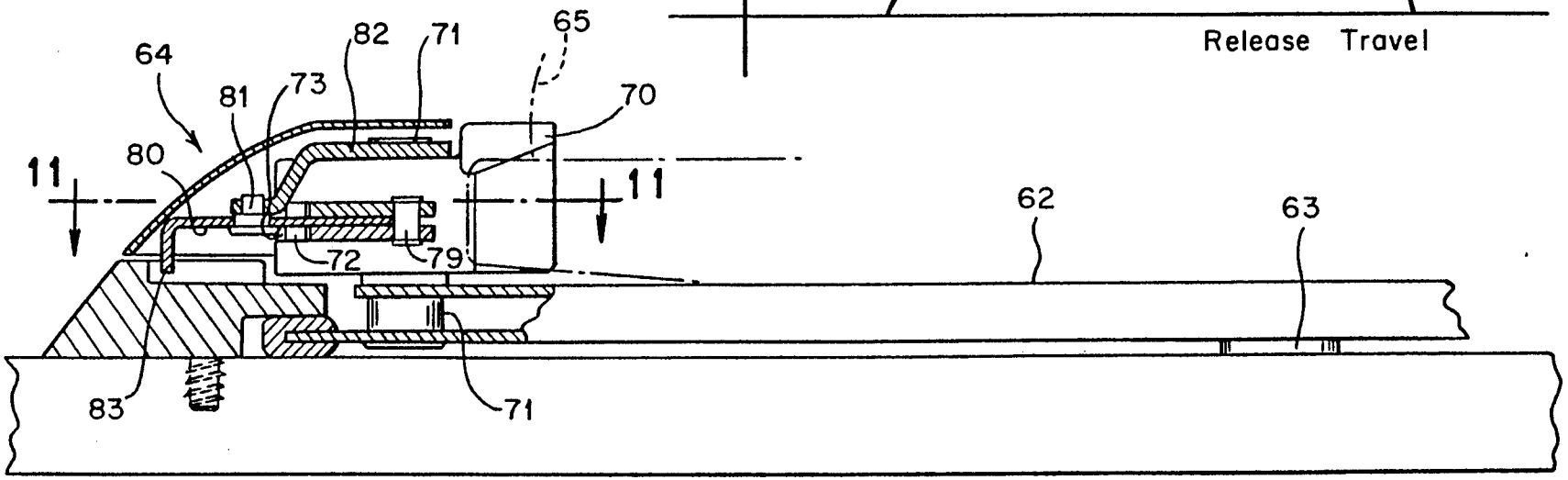
FIG. 10 is a view in longitudinal section through a safety ski binding according to the invention taken along line X—X in FIG. 11.
Figure 11:
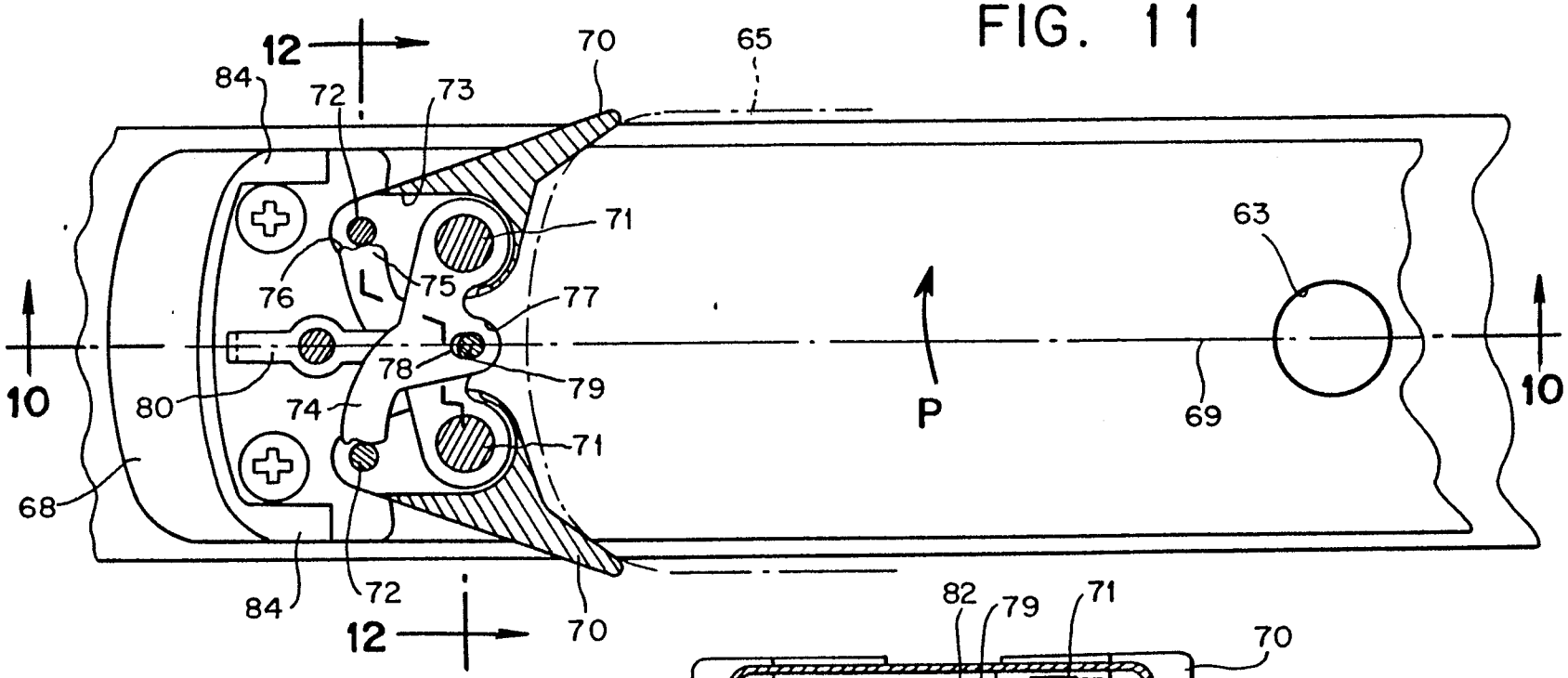
FIG. 11 is a plan view of the safety ski binding in FIG. 10, partly in section taken along line XI—XI in FIG. 10, wherein upper parts of the ski binding are omitted for the sake of enhanced clarity.
Figure 12:
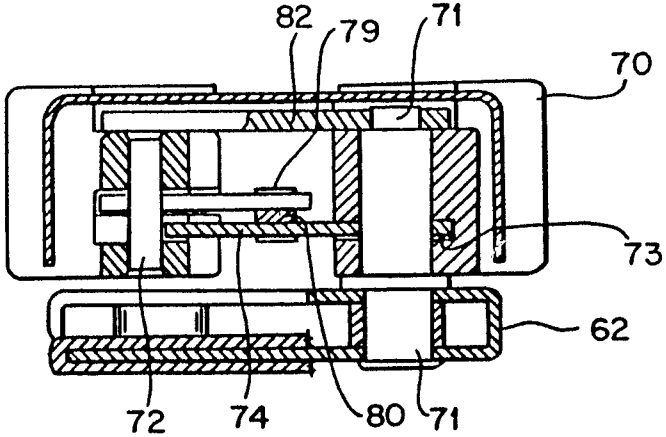
FIG. 12 is a view in cross-section taken along line XII—XII in FIG. 11.
Figure 13:
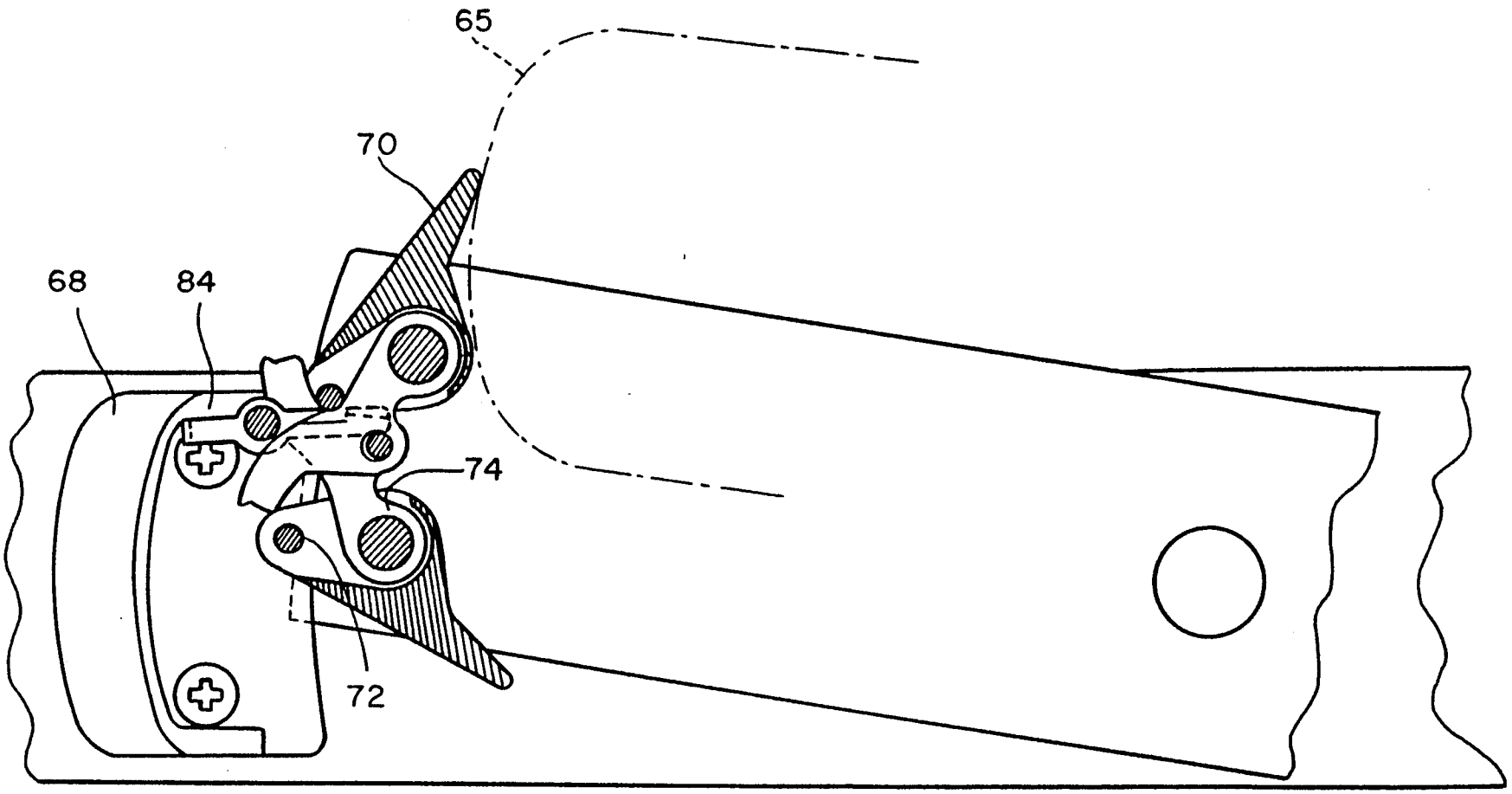
Figure 14:
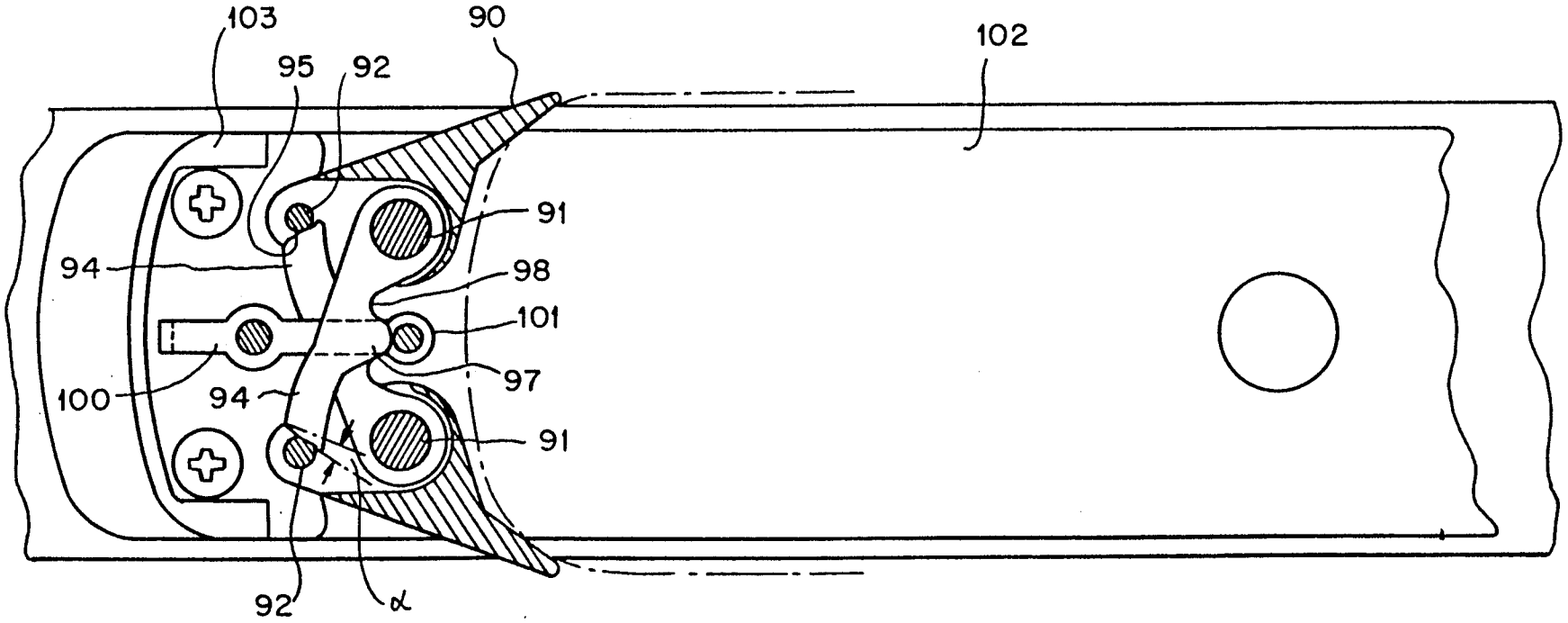

FIG. 13 is a view similar to that shown in FIG. 11 of the ski binding illustrated in FIGS. 10 through 12 in the release position of the right-hand sole holder; and FIG. 14 is a plan view similar to that shown in FIG. 11 of a modified embodiment of the safety ski binding, Referring to the view shown in FIGS. 3 through 5, a first embodiment of a safety ski binding according to the invention is mounted on a ski 21. The ski binding has a sole plate 22 which is pivotably about a pin 23 which is secured to the ski, in a plane parallel to the surface of the ski. In per se known manner, the pin 23 also permits a slight vertical movement of the sole plate 22 relative to the surface of the ski in order thereby to permit flexing movements of the ski without deformation of the sole plate.

A front sole holding arrangement which is generally indicated by reference numeral 24, for the front edge of the sole of a ski boot 25 which is only indicated is secured to the front end of the sole plate 22. The sole plate 22 is made up of two mutually parallel metal or plastic plates which are held at a spacing by pins 26. The lower one of those plates projects forwardly relative to the upper one and engages with a sliding element 27 of low-friction material, for example Teflon, under a front jaw 28 which is fixed screwed to the ski and which is open at both sides. The sole plate 22 is pivotably about the pin 23 against the action of resilient holding means of a heel holding arrangement (not shown), as described in the opening part of this specification.

The front sole holding arrangement 24 has two sole holders 30 which are arranged symmetrically with respect to the longitudinal center line 29 of the sole plate 22 and which are in the form of double-armed levers, the rear lever arm of which embraces the front edge of the sole of the ski boot 25 from above (see FIG. 3) and from the side. The sole holders 30 are pivotably about pins 31 which project upwardly from the sole plate 22 and at their forwardly projecting arms each carry a respective guide link 32 which is pivotally mounted by one end to an axis member 33 of the sole holder 30 and extends substantially transversely with respect to the longitudinal center line 29. The free ends of the guide links 32 are inclined at an angle which opens rearwardly as viewed in FIG. 4 and are in the form of support ends 34 with which the guide links 32 bear against the cylindrical peripheral surface of the head of a pin 35. That head therefore forms a support element for the guide links 32. The pin 35 is carried on a plate 36 which is accommodated in a slot-shaped opening in the sole holder 30 and is rigidly fixed to the pivot pin 31 thereof. At the underside of a forwardly projecting nose 36' of the plate 36, that is to say in the same plane as the support element 35, a release member 37 in the form of a single-arm pivot lever is mounted pivotably parallel to the plate 36. At abutment pin 38 projects downwardly from the pivot lever 37. The free end 39 of the pivot lever 37 is of a contour in the form of a circular arc with a radius corresponding to its spacing relative to the pivot axis of the pivot lever 37, and it thus forms a support surface against which the front sides of the support ends 34 of the guide links 32 bear. The pivot lever 37 is held in its central position shown in FIG. 4 by a weak spring (not shown). The illustrated release arrangement is covered by a cap 40 which is secured to the front jaw 28 in a manner which is not shown in greater detail, and is thus protected from snow and dirt.

In the illustrated holding position of the sole holders, forces acting outwardly thereon from the edge of the sole of the ski boot 25 are transmitted to the guide links 32 and act as support forces at the support element 35.

As the support ends 34 are inclined and therefore the line of the support force which is active in each guide link 32, that is to say the connecting line between the axis member 33 and the point of contact of the support end 34 with the support element 35, is not normal to the support end 34, the support force develops at the support element 34, on the basis of the principle of the inclined plane, a forwardly directed force component which seeks to move the support end 34 in the direction towards the release member 37. That movement however is prevented by the support surface 39 of the release member 37 which carries said force component as a support force portion. The magnitude of that support force portion can be fixed by the magnitude of the angle of inclination at the support end 34 and can be selected to be of a very low value to just before the range of self-locking due to friction. The sole holders 30 are therefore held in their illustrated holding position by a support force equilibrium in which the by far predominant part of the support force is short-circuited by the guide links 32 being supported against each other, by way of the support element 35, while the remaining portion thereof is carries by the release member 37.

If, due to the holding force of the resilient holding means in the heel holding arrangement (not shown) being exceeded, the sole plate 22 is pivoted for example in the direction indicated by the arrow P and in so doing exceeds an angle of pivotal movement which is determined by the distance of the abutment finger 38 from an abutment wall 28' of the front jaw 28, then, by means of the abutment finger 38, the pivot lever 37 is pivoted downwardly in FIG. 4, overcoming the spring force of the weak spring (not shown), with the support surface 39 sliding with a small amount of friction against the front side of the guide links 32. As a result the support end 34 of the guide link 32 which leads in the direction of pivotal movement of the sole plate is release so that the guide link is displaced forwardly instantaneously as a result of the lateral force which acts on the corresponding sole holder 30 and which is applied by the ski boot 25, and on the basis of the deflection action of the support element 35. In that way the sole holder 30 can pivotally deflect and laterally release the ski boot 25.

Figure 6:
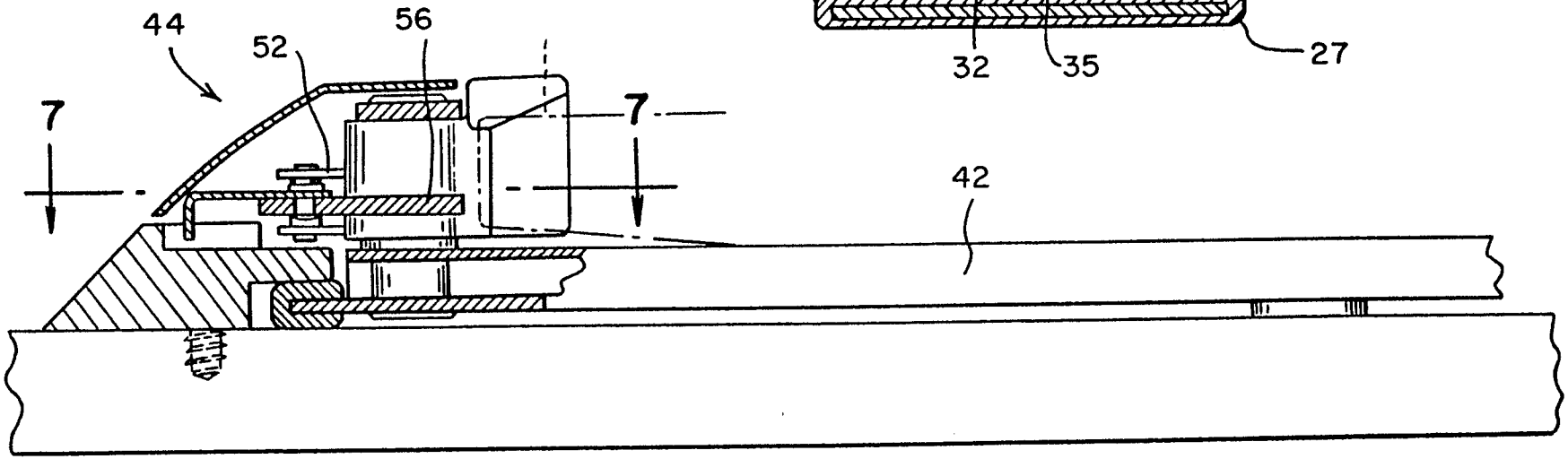
FIGS. 6, 7 and 8 are views in section similar to those shown in FIGS. 3 through 5 of a further embodiment of the ski binding according to the invention, in section respectively taken along line VI—VI in FIG. 7, line VII—VII in FIG. 6 and line VIII—VIII in FIG. 7.
Figure 7:
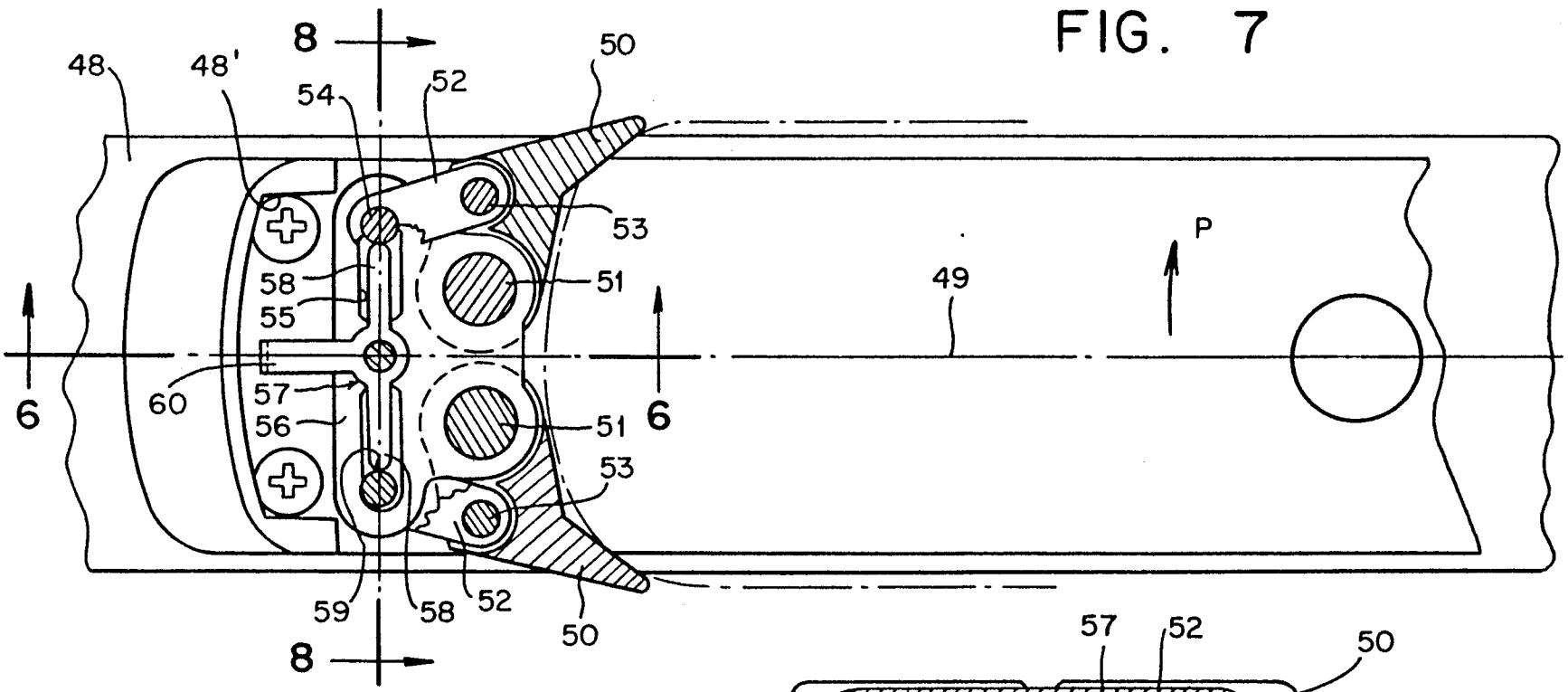
Figure 8:
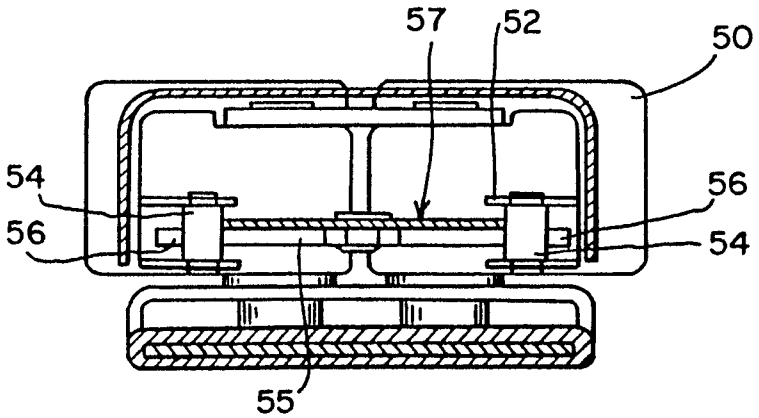
Figure 9:
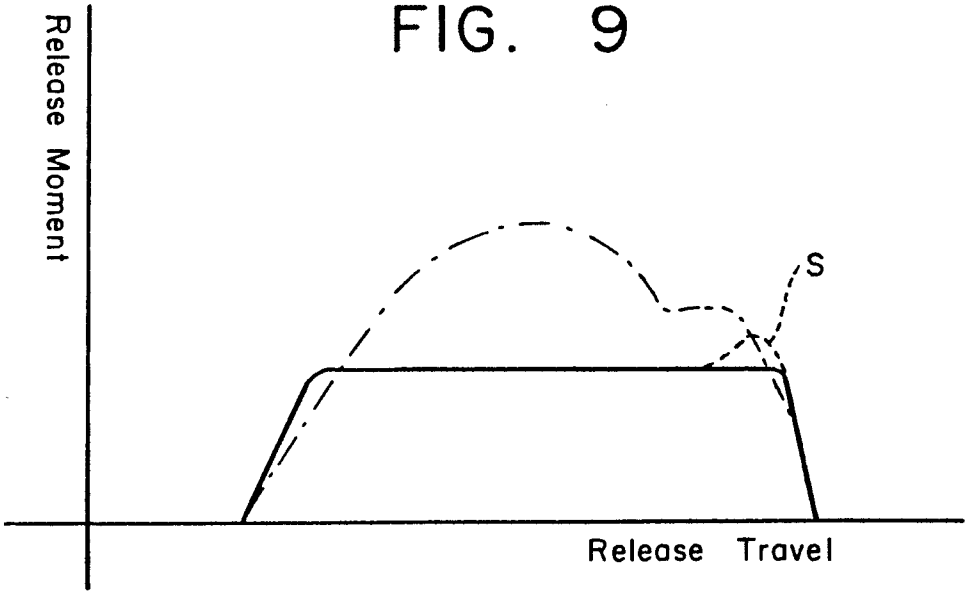
FIG. 9 shows a diagram illustrating the force/torque configuration upon release of a safety ski binding with sole plate.

The embodiment shown in FIGS. 6 through 8 is of the new configuration as the above-described embodiment, in regard to the sole plate configuration and holding arrangement. What is different is the structure of the front sole holding arrangements 44. Therein the sole holders 50 are in the form of single-arm levers which are pivotable parallel to the sole plate on pins 51 which project upwardly from the sole plate 42. Pivotally mounted at the front side of the sole holders 50 in a recess thereof are guide links which in this embodiment are formed by two mutually parallel guide link bars which are disposed one above the other and which are connected at their free ends by a spacer and slide pin 54. A plate 56 is accommodated in parallel relationship to the sole plate 42 in a slot-shaped opening in the sole holders 50 and is rigidly fixed to the pivot pin 51. In its portion which projects forwardly from the sole holders 50, the plate 56 has slots 55 which are arranged symmetrically relative to the longitudinal center line 49 of the sole plate 42 and which extend perpendicularly to the longitudinal center line 49, with the slide and spacer pins 54 each extending through a respective one of the slots. In addition a three-armed release member 57 is mounted on the plate 56 pivotably parallel to the plate 56 on the longitudinal center line 49 and between the mutually facing ends of the slots 55. Two arms 58 of the release member 57 extend in oppositely disposed relationship parallel to the slots 55 and at their ends have support surfaces 59 against which the respective slide and spacer pins 54 bear. Projecting forwardly in perpendicular relationship thereto is an abutment arm 60 with a downwardly bent portion at the front end, which is intended to cooperate with the abutment wall 48' of the front jaw 48. The support surfaces 59 may have an edge contour in the shape of a circular arc corresponding to their radius relative to the pivot axis of the release member 57.

In the illustrated holding position of the sole holders 50, the side force applied thereto by the front edge of the sole of the ski boot is converted into a support force which acts in the longitudinal direction of the guide links 52. The line of that support force substantially coincides with the connecting line between the axes of the slide and spacer pins 54 and the pivot pins 53 of the guide links 52. That line of force is not perpendicular to the side of the respectively associated slot 55 but departs from that perpendicular line by a small angle of for example between 6° and 10° and it is also so directed that the lines of force of both guide links converge forwardly in the longitudinal direction of the ski. By virtue of that arrangement, once again on the basis of the principle of the inclined plane, there is a support force component which is directed parallel to the side of the slot and by which the slide and spacer pins 54, at the support ends of the guide links 52, are pressed against the support surfaces 59 of the release member 57. Here too the support force is therefore divided into a large portion which is carried by the side of the slot and a support force portion which is carried by the release member 57 and which is considerably less.

If the sole plate 42 is pivotally deflected for example in the direction indicated by the arrow P by virtue of the action of an external torque on the ski boot, than after the forwardly projecting arm 60 comes to bear against the abutment wall 48', the release member 57 is pivoted against the action of a weak holding spring (not shown) which holds the release member 57 in the illustrated central position. As a result the supporting effect provided by the support surfaces 59 on the sliding and spacer pins 54 at the support ends of the guide links 52 disappears and the latter instantaneously both pivot inwardly so that accordingly both sole holders 50 are simultaneously released and can move into their release position. The simultaneous release of both sole holders is advantageous as in that way the front edge of the sole of the ski boot is also instantaneously released upwardly.

In both the above-described embodiments of the ski binding according to the invention, for the purposes of release of the sole holders, it is only necessary to overcome the friction and the very small spring force which holds the release member in its central position or returns it thereto. The amount of friction between the support ends of the guide links and the support surfaces on the release member is also very small because in the normal course of events the support force portion which is transmitted to those support surfaces only constitutes a small fraction of the total support force.

In both embodiments the illustrated holding position of the sole holders and the corresponding positions of the individual components by pivoting the sole holders back into position by hand or by their being pivoted back into position by a light spring acting on the sole holders.

The pivot axis about which the guide links are pivoted when they move from their support position, namely in the event of safety release of the ski binding, is therefore not disposed on the sole holders which are movable themselves, but on a mounting portion which is fixedly connected to the sole plate. On the other hand however the support elements against which the guide links are so supported that they are urged under the effect of the support force against the support surface of the release member are each arranged on the self-pivotable sole holders.

The above-mentioned saving in terms of components can now be achieved by virtue of using those pivot axis members about which the sole holders are pivotable as mounting portions for pivotal mounting of the guide links on the sole plate. In that way the guide links, in mutually intersecting relationship, can extend from the one sole holder, namely from the axis member thereof which is fixedly connected to the sole plate, to the associated support element which is arranged on the other sole holder. In this arrangement also it is possible to use only a single release member for both guide links if, in addition to the support ends of the guide links with which they bear exclusively against the respectively associated support element, provided on the guide links in their intersection portion is a respective support portion with which the guide links can bear against the support surface of a release member which is common to both guide links.

In the illustration shown in FIGS. 10 through 13, the ski binding has a sole plate 62 which is pivotable about a pin 63 fixed on the ski, in a plane which is parallel to the surface of the ski. A front sole holding arrangement which is generally identified by reference numeral 64, for the front edge of the sole of the ski boot 63 which is once again only indicated, is fixed to the front end of the sole plate 62. The sole plate 62 is of the same structure as is described in the embodiments set forth in the main application and is pivotable about the pin 63 against the action of resilient holding means of the heel holding arrangement (not shown).

The front sole holding arrangement 64 has two sole holders 70 which are arranged symmetrically relative to the longitudinal center line or line of symmetry 69 of the sole plate 62 and which are in the form of two-armed levers and the rear sole holder arm of which embraces the front edge of the sole of the ski boot 65 from above and from the side. The sole holders 70 are pivotable about pins 71 which project upwardly from the sole plate 62 and which are fixedly connected thereto, and the sole holders 70 are provided substantially centrally between their top side and their bottom side with an opening 73 which is open forwardly and towards the center line 69; a respective pin member 72 forming a support element passes through the respective opening 73 in the vicinity of the front end of the respective sole holder 70. A guide link 74 is arranged in each opening 73 and is mounted pivotably about the pin 71 which is exposed in the opening 73. The two guide links 74 extend in mutually intersecting relationship to the respective pin member 72, which forms the associated support element, of the oppositely disposed sole holder 70, and the guide links 74 bear with their support ends 75 against the cylindrical peripheral surface of the pin member 72. At its forward edge the contact surface of each support end 75 has a small nose or projection 76 and in its rearwardly directed configuration is so inclined or provided with a rounding that, for the adjoining pin member 72, it forms an inclined plane whose angle opens forwardly. By virtue of that arrangement, as already discussed in the above-described embodiments, the support force acting on the respective support ends 75 gives rise to a forwardly directed force component which seeks to move the support ends 75 and therewith the guide links 74 forwardly, that is to say towards the left in FIG. 11. The nose 76 is not significant in terms of that function; it is also not necessary and serves only as a safeguard against the guide links 74 being able to be pivoted rearwardly upon actuation of the sole holders 70.

In the portion 77 in which the guide links are in mutually intersecting relationship, they have a rearwardly projecting outwardly formed portion in which there is provided a bore 78. The bores 78 in the two guide links are disposed in substantially aligned and superposed relationship in the support position of the guide links as is shown in FIG. 11, and accommodates a connecting pin member 79 which is somewhat enlarged at its upper and lower ends so that it cannot drop out of the bores 78. The diameter of the connecting pin member 79 is so matched to the diameter of the bores 78 that it has sufficient clearance therein to permit the pivotal movement of the guide links 74 relative to each other, which will be described hereinafter and which is shown in FIG. 13.

The rear end of a double-arm pivot lever 80 which is operative as a release member and which is pivotable about an axis formed by a pin 81 bears against the forwardly facing peripheral surface of the connecting pin member 79. The pin 81 is riveted by means of its upper end portion in an angle plate 82 which is only shown in FIG. 10 and which is fixed to the pin 71, above the sole holders 70, in a manner which is not shown in greater detail.

The pin 81 which forms the axis of the pivot lever 80 lies on the line of symmetry 69 and the rear arm of the pivot lever 80 extends in a straight line through between the guide links 74 in the intersection portion thereof (see FIG. 10). The front arm of the pivot lever 80 is angled downwardly at 83 so that, upon a pivotal movement of the sole plate 62 about the pin 63 thereof, the front arm of the pivot lever 80 can come to bear against one of the side walls 84 of the front jaw 68. The end of the pivot lever 80, which bears against the connecting pin member 79, can be rounded with a comparatively large radius, for example corresponding to the length of the rear arm as far as the pivot axis 81. In addition the pivot lever 80 is acted upon by a very light spring (not shown) which seeks to hold it in the central position shown in FIG. 11. In use of the safety ski binding the front edge of the sole of the ski boot 65 is so pressed against the sole holders 70 by the heel holding arrangement (not shown) that a spreading force which seeks to pivot the sole holders 70 outwardly acts at the rear sole holder arms. However a pivotal movement of that nature is prevented by the guide links 74 which receive corresponding support forces from the pins 72. In that situation the above-mentioned forwardly acting force component which urges the guide links 74 forwardly is carried by the pivot lever 80 which acts as a release member. In that situation the forwardly acting force component is transmitted by the connecting pin member 79 in the intersection portion 77 of the guide links 74 to the rear end of the pivot lever 80.

If, due to the holding force of the resilient holding means in the heel holding arrangement (not shown) being exceeded, the sole plate 62 is pivoted in the direction indicated by the arrow P (FIG. 11) and in so pivoting exceeds a pivot angle which is determined by the distance of the angle portion 83 of the pivot lever 80 relative to the side wall 84 of the front jaw 68, then the front arm of the pivot arm 80 is pivoted to the side (downwardly in FIGS. 11 and 13) and thereby the rear end of the pivot lever is taken out of supporting contact with the connecting pin member 79. In that case the above-mentioned forwardly directed force component of the support force acting at the guide links 74 instantaneously causes forward pivotal movement of the guide links so that they move into the position shown in FIG. 13. As a result of the two guide links 74 being connected by means of the connecting pin member 79, both guide links are moved out of their support position with the associated support element 72 and consequently both sole holders 70 are released. As the conneeting pin member 79 is held in the bores 78 with sufficient play, it does not impede the guide links 74 in assuming the release position shown in FIG. 13.

The embodiment illustrated in FIG. 14 differs from that shown in FIGS. 10 through 13 only by virtue of a different configuration of the guide links 94 and the pivot lever 100 forming the release member. In other respects the structure of the front sole holding arrangement is the same as that of the embodiment just described above, and therefore does not need to be described in greater detail here.

The contact surface of the support end 95 of the guide links 94 forms, relative to the associated pin members 92 which represent the support element, an inclined plane whose angle $\alpha$ is open rearwardly. Consequently the support force which respectively obtains between the support elements 92 and the support ends produces a force component in a rearward direction. In their intersection portion 97 the guide links 94 have a rearwardly directed projection which projects sufficiently far to provide a recess 98 on the side of the projection 97 which is towards the respective pin 91.

At its rear end the pivot lever 100 carries a thickened portion 101 in the form of an upwardly and downwardly projecting pin which forms a support surface for the projection 97, which bears thereagainst, of the intersection portion of the guide links.

As in this embodiment the above-mentioned support force component at the guide links 94 acts in a rearward direction, the guide links 94 are urged with the projection 97 against the front peripheral surface of the thickened portion 101. In that situation, unlike the above-described embodiment, the rear arm of the pivot lever 100 is not subjected to a compression loading but to a tensile loading.

If, as a result of a pivotal movement of the sole plate 102 and by virtue of the front lever arm of the pivot lever 100 coming to bear against one of the side walls 103, the thickened portion 101 moves out of supporting contact with the projection 97 of the guide links 94, the guide links 94 are instantaneously pivoted rearwardly by the rearwardly acting support force component so that the sole holders 90 can pivotally deflect. When that happens the thickened portion 101 passes into the recess 98 of one of the two guide links 94, which must be of sufficient depth to permit adequate pivotal movement of the corresponding guide link.

In connection with this embodiment moreover it could be envisaged arranging for the pin forming the thickened portion 101, in the intersection portion 97, to engage into a respective bore in the guide links 94, in a similar manner to that described above in connection with the embodiment shown in FIGS. 10 through 13, in respect of the connecting pin member 79 therein. In that case the pivot lever 100 would be reduced to a pure pulling bar member as the release member, which at the position of the pivotal mounting of the pivot lever 100, bears by means of a support surface against a pin taking the place of the mounting pin, and in the release situation can deflect laterally and rearwardly with the support surface, relative to said pin.

Insofar as reference is made in the foregoing description to an inclined plane and the angle of opening thereof, that means that angle $\alpha$ that forms the contact surface, which bears against the associated support element, of the support end of the guide links, with a line perpendicular to the line of action of the support force in the guide link. The line of action of the support force in the guide link is in each case the connecting line between the center point of the guide link mounting and the point of contact of the contact surface at the support end with the support element. The line of action of the support force in the guide link 94 and the angle $\alpha$ of the inclined plane at that guide link is shown in dash-dotted lines in FIG. 14. In the event that, as in the above-described embodiments, the inclined plane is formed by the contact surface which is provided at the support ends of the guide links, the guide link and therewith the inclined plane itself is moved by the support force component which is liberated in the release procedure. If however, as is also conceivable, the inclined plane is provided on the support element, then the angle of opening thereof to give the above-indicated effect in terms of movement of the guide links, is then open in the opposite direction.

In the embodiments shown in FIGS. 10 through 14, the sole holders are also acted upon by return springs which are not specifically shown and which, after deflection of the sole holders into their release position, return the sole holders to the central position shown in FIGS. 11 and 14. The return springs may be coil springs which are wound around the mounting pins of the sole holders or leg springs which are disposed between the sole holders.

I claim:

1. A safety ski binding comprising:

a sole plate having a front end and a rear end;

means for pivotably connecting the sole plate to a ski;

first and second sole holders positioned towards the front end of the sole plate, each of said sole holders being pivotable about an axis substantially perpendicular to the sole plate, said sole holders being operable between a holding position in which the sole holders embrace the front edge of the sole of a ski boot and a release position in which they release said front edge of the sole outwardly;

release means for the sole holders comprising first and second guide links pivotably connected to each of the sole holders and having support ends remote from said sole holders, a release member mounted movably on the sole plate, and abutment means which are fixed with respect to the ski, and wherein in the holding position of the sole holders the support ends of the guide links are supported by the release member and thereby fix the sole holders in the holding position thereof and after a predetermined angle of pivotal movement of the sole plate relative to the surface of the ski is exceeded at least one of the guide links is moved out of its support position by displacement of the release member when it comes to bear against said abutment means and thereby permits pivotal movement of the associated sole holder into the release position thereof; and a support element attached to the sole plate and positioned such that each guide link support end bears against the support element at an angle such that a component of a support force transferred from said sole holder urges said guide link support ends toward said release member and said support force is thereby distributed in respective portions to the support element and the release member, and wherein the respective portion of the support force carried by the release member is less than the respective portion of the support force carried by the support element.

2. A ski binding as set forth in claim 1 wherein the support element is a pin means which projects from the sole plate.

3. A ski binding as set forth in claim 2 wherein the support element is common to both guide links and wherein the guide links are directed towards each other with their support ends in the holding position of the sole holders and bear against the oppositely disposed sides of the common support element.

4. A ski binding as set forth in claim 3 wherein the release member is a pivot arm with a pivot axis which is directed perpendicularly to the sole plate and which is arranged on a longitudinal center line of the sole plate.

5. A ski binding as set forth in claim 4 wherein said pivot arm has an abutment finger which projects at least substantially perpendicular to the plane of pivotal movement of the pivot arm for co-operation with said abutment means which are fixed with respect to the ski, upon pivotal movement of the sole plate.

6. A ski binding as set forth in claim 1 wherein the support element includes a pair of slots, and wherein the support end of one of said guide links slidably engages one of said slots, and wherein the support end of the other of said guide links slidably engages the other of said slots.

7. A ski binding as set forth in claim 6 including a pin member disposed at the support end of each of said guide links for engaging one of the slots.

8. A ski binding as set forth in claim 6 wherein said release member is a two-armed pivot lever whose pivot axis is disposed centrally between the slot guides surrounding said slot and wherein said support ends of said guide links bear against the arms of said pivot levers when said sole holders are in the holding position.

9. A ski binding as set forth in claim 8 wherein said slot guides are arranged at least substantially in alignment with each other symmetrically and perpendicularly to the longitudinal center line of the sole plate, wherein the axis of the pivot lever extends at least substantially perpendicularly to the sole plate, and wherein the pivot lever is an elongated lever having an abutment arm which sticks out perpendicularly to its own arms.

10. A ski binding as set forth in claim 1 wherein the release member has a support surface against which the support ends of both guide links jointly bear.

11. A ski binding as set forth in claim 1 wherein said release member is movable about a pivot axis and has a contact support surface which is rounded with a radius corresponding to the spacing of the support surface from the pivot axis of the release member.

12. A ski binding comprising:

a sole plate having a front end and a rear end;

means for pivotably connecting the sole plate to a ski;

first and second sole holders positioned towards the front end of the sole plate, each of said sole holders being pivotable about an axis substantially perpendicular to the sole plate, said sole holders being operable between a holding position in which the sole holders embrace the front edge of the sole of a ski boot and a release position in which they release said front edge of the sole outwardly;

release means for the sole holders comprising first and second guide links pivotably connected to each of the sole holders and having support ends remote from said sole holders, a release member mounted movably on the sole plate, and abutment means which are fixed with respect to the ski, and wherein in the holding position of the sole holders the support ends of the guide links are supported by the release member and thereby fix the sole holders in the holding position thereof and after a predetermined angle of pivotal movement of the sole plate relative to the surface of the ski is exceeded at least one of the guide links is moved out of its support position by displacement of the release member when it comes to bear against said abutment means and thereby permits pivotal movement of the associated sole holder into the release position thereof; and a support element carried on each sole holder and so positioned such that each guide link support end bears against the support element at an angle such that a component of a support force transferred from said sole holder urges the guide links support ends toward the release position and said support force is thereby distributed in respective portions to the support element and the release member, and wherein the respective portion of the support force carried by the release member is less than the respective portion of the support force carried by the support element.

13. A ski binding as set forth in claim 12 wherein the sole holders and the guide links are pivotably mounted to the sole plate at the same location and wherein respective guide links each extend in mutually intersecting relationship from the one sole holder to the support element of the respective other sole holder.

14. A ski binding as set forth in claim 13 wherein said release member is common to both guide links, wherein the support ends of the guide like are each in supporting contact only with the respectively associated support element and wherein in their intersection portion the guide links each have a support portion with which they bear against the support surface of the common release member.

15. A ski binding as set forth in claim 14 wherein the guide links each have a respective bore in their intersection portion, wherein the bores are at least substantially aligned with each other, wherein a pin member which passes through both bores is held movably transversely with respect to its axis in the bores thereby to act as the support portion and wherein the release member is a pivot lever mounted on the sole plate and having an end portion providing a support surface bearing against the pin member.

16. A ski binding as set forth in claim 15 wherein the pivot lever which forms the release member is mounted on the axis of symmetry of the sole plate and in front of the sole holders.

17. A ski binding as set forth in claim 16 wherein the support ends of the guide links form a contact surface for the associated support elements, the contact surface being in the form of an inclined plane whose angle opens forwardly, wherein the guide links are adapted to be urged forwardly with their pin member forming the support portion against the end of the pivot lever which forms the release member.

18. A ski binding as set forth in claim 14 wherein in their intersection portion the guide links each have a respective rearwardly directed projection and wherein the release member is a pivot lever mounted on the sole plate and having an end portion in the form of a support surface bearing against both projections.

19. A ski binding as set forth in claim 18 wherein the pivot lever which forms the release member is mounted on the axis of symmetry of the sole plate and in front of the sole holders.

20. A ski binding as set forth in claim 19 wherein the support ends of the guide links form a contact surface for their associated support elements, the contact surface being in the form of an inclined plane whose angle opens rearwardly, wherein the pivot lever forming the release member engages over the intersection portions of the guide links and the support surface is formed by a thickened portion provided at the end of the pivot lever, and wherein the guide links with their projections forming the support portion are urged rearwardly against the thickened portion.

21. A ski binding as set forth in claim 20 wherein the thickened portion is a pin fixed to the end of the pivot lever.

22. A ski binding as set forth in claim 19 wherein the support ends of the guide links form a contact surface for their associated support elements, the contact surface being in the form of an inclined plane whose angle opens rearwardly, wherein the pivot lever forming the release member engages under the intersection portions of the guide links and the support surface is formed by a thickened portion provided at the end of the pivot lever, and wherein the guide links with their projections forming the support portion are urged rearwardly against the thickened portion.

23. A ski binding as set forth in claim 22 wherein the thickened portion is a pin fixed to the end of the pivot lever.

24. A ski binding as set forth in claim 12 wherein the support elements are arranged adjacent the front end of the respective sole holders.

25. A release arrangement for a safety ski binding operable between a holding position wherein a ski boot is maintained in said binding and a release position wherein said ski boot is released from said ski binding, said ski binding including a sole plate having at least one sole holder for holding said ski boot attached thereto comprising:

at least one guide link pivotably connected to said sole holder at one of its ends, the other end of said guide link travelling between a first position when said ski binding is in said holding position and a second position when said ski binding is in said release position;

a support element attached to said sole plate for supporting said other end of said guide link when said ski binding is in said holding position, said guide link configured to transfer a support force from said sole holder to said support element such that a component of said force acts in a direction tending to urge said guide link towards said release position; and a release member positioned proximate said guide link to counteract said component of said force when said ski binding is in said holding position.

26. A release arrangement for a safety ski binding operable between a holding position wherein a ski boot is maintained in said binding and a release position wherein said ski boot is released from said ski binding, said ski binding including a sole plate having first and second sole holders for holding said ski boot attached thereto comprising:

first and second guide links pivotably connected to said first and second sole holders respectively at one of their ends, the other ends of said guide links travelling between a first position when said ski binding is in said holding position and a second position when said ski binding is in said release position;

a support element carried on each of said sole holders for supporting said other ends of said guide links when said ski binding is in said holding position, said guide links configured to transfer a support force from said ski boot to said support element such that a component of said force acts in a direction tending to urge said guide link towards said release position; and a release member positioned proximate said guide link to counteract said component of said force when said ski binding is in said holding position.

27. A safety ski binding comprising:

a sole plate having a front end and a rear end;

means for pivotably connecting the sole plate to a ski;

first and second sole holders positioned towards the front end of the sole plate, each of said sole holders being pivotable about an axis substantially perpendicular to the sole plate, said sole holders being operable between a holding position in which the sole holders embrace the front edge of the sole of a ski boot and a release position in which they release said front edge of the sole outwardly;

release means for the sole holders comprising first and second guide links pivotably connected to each of the sole holders and having support ends remote from said sole holders, a release member mounted movably on the sole plate, and abutment means which are fixed with respect to the ski, and wherein in the holding position of the sole holders and support ends of the guide links are supported by the release member and thereby fix the sole holders in the holding position thereof and after a predetermined angle of pivotal movement of the sole plate relative to the surface of the ski is exceeded at least one of the guide links is moved out of its support position by displacement of the release member when it comes to bear against said abutment means and thereby permits pivotal movement of the associated sole holder into the release position thereof; and wherein the support ends of the guide links bear against each other at an angle such that a component of a support force transferred from said sole holder urges said guide link support ends toward said release member and said support force is thereby distributed in respective portions to the support end of the opposing guide link element and the release member, and wherein the respective portion of the support force carried by the release member is less than the respective portion of the support force carried by the support end of the opposing guide link.

* * * * *

UNITED STATES PATENT AND TRADEMARK OFFICE

CERTIFICATE OF CORRECTION

PATENT NO. : 5,240,275

DATED : 8/31/93

INVENTOR(S) : Roland Jungkind

It is certified that error appears in the above-identified patent and that said Letters Patent is hereby corrected as shown below:

| | |
|---|---|
| Column 1, line 46, | "short distance" should be --short duration--; |
| Column 2, line 11, | "deceases" should be --decreases--; |
| Column 2, lines 24-25, | "a predistranstial force" should be --a substantial force--; |
| Column 3, line 58, | "components," should be --components.--; |
| Column 4, line 24, | "binding," should be --binding.--; |
| Column 4, line 28, | "is pivotably" should be --is pivotable--; |
| Column 4, line 45, | "is pivotably" should be --is pivotable--; |
| Column 4, line 55, | "are pivotably" should be --are pivotable--; |
| Column 5, line 44, | "is carries" should be --is carried--; |
| Column 5, line 58, | "is release" should be --is released--; |
| Column 5, lines 65-66, | "of the new" should be --of the same--; |

UNITED STATES PATENT AND TRADEMARK OFFICE

CERTIFICATE OF CORRECTION

PATENT NO. : 5,240,275

DATED : 8/31/93

INVENTOR(S) : Roland Jungkind

It is certified that error appears in the above-identified patent and that said Letters Patent is hereby corrected as shown below:

| | |
|---|---|
| Column 6, line 1, | "arrangements" should be --arrangement--; |
| Column 7, line 19, | after "the individual components" insert --of the release arrangement can be restored once release has occurred--; |
| Column 8, line 41, | "accommodates" should be --accommodate--; |
| Column 13: Claim 14, line 3, | "guide like" should be --guide links--; |
| Column15: Claim 27, line 19, | "and support ends" should be --the support ends--. |

Signed and Sealed this

Tenth Day of May, 1994

Bruce Lehman

BRUCE LEHMAN

*Commissioner of Patents and Trademarks*

*Attest:*

*Attesting Officer*